United States Patent [19]

Seward

[11] 4,062,993

[45] Dec. 13, 1977

[54] TEXTILE AND METHOD OF MAKING SAME

[76] Inventor: William W. Seward, Dug Gap Road - P.O. Box 1068, Dalton, Ga. 30720

[21] Appl. No.: 572,840

[22] Filed: Apr. 29, 1975

Related U.S. Application Data

[63] Continuation of Ser. No. 365,487, May 31, 1973, abandoned.

[51] Int. Cl.[2] ..... D03D 27/00

[52] U.S. Cl. ..... 428/93; 28/107; 156/72; 156/148; 428/95; 428/96; 428/97; 428/137; 428/138; 428/234; 428/247; 428/297; 428/303; 428/332; 428/337; 428/457

[58] Field of Search ..... 428/93, 95, 96, 97, 428/138, 234, 235, 245, 300, 457, 247, 303, 332, 297, 337; 156/72, 148; 28/72.2

[56] References Cited

U.S. PATENT DOCUMENTS

| | | | |
|---|---|---|---|
| 3,112,552 | 12/1963 | Smith | 428/91 |
| 3,415,713 | 12/1968 | Smith | 428/293 |
| 3,428,506 | 2/1969 | Johnstone | 156/148 |
| 3,695,270 | 10/1972 | Dostal | 19/44.5 |
| 3,713,960 | 1/1973 | Cochran | 428/92 |
| 3,728,204 | 4/1973 | Cochran | 428/95 |

FOREIGN PATENT DOCUMENTS 1,583,947 10/1969 France.

*Primary Examiner*—James J. Bell
*Attorney, Agent, or Firm*—Hill, Gross, Simpson, Van Santen, Steadman, Chiara & Simpson

[57] ABSTRACT

This invention relates to a reinforced fabric composition and to a method of making the same. The fabric composition includes a fabric base, a heat conductive metallic foil secured to the base, and a non-woven batt of fibers over the metallic foil, the batt and the foil being mechanically locked to the base solely by fibers of the batt which have been pushed through the foil and through the base and are locked against the bottom of the base. The preferred method of the present invention involves applying the metallic foil over a web of the fabric base, applying a non-woven batt of fibers over the foil and needle punching the resulting composite with barbed needles while incrementally advancing the composite to force fibers from the batt through the foil and through the fabric base to thereby densify the composite and securely interlock the fabric base, the foil and the batt together.

14 Claims, 9 Drawing Figures

TEXTILE AND METHOD OF MAKING SAME

This application is a continuation of my co-pending application Ser. No. 365,487 filed May 31, 1973, now abandoned.

BACKGROUND OF THE INVENTION

1. Field of the Invention

The present invention is in the field of fabric compositions which include a metallic foil mechanically secured between the fabric base and an overlying layer of a non-woven batt, the bonding between the various layers of the fabric being essentially mechanical without the necessity of employing adhesive compositions and the like.

2. Description of the Prior Art

The has been a substantial emphasis in recent years on setting standards for flame retardency which are applicable to all textile products, including carpeting. Meeting these standards has provided substantial problems for manufacturers of these products.

One of the approaches has been to add various flame-retarding chemicals to the coating or backing compounds or to the face yarns or fibers during or after manufacturing. However, this type of approach has not been entirely successful because the chemical agents tend to lose their effectiveness as the carpet ages and becomes soiled after installation. In addition, it is a difficult matter to blend the additives properly and to secure uniform treatment of the fiber backing or the face yarns of fibers during manufacture of the product.

SUMMARY OF THE INVENTION

The present invention provides a composite structure including a heat dissipating metallic foil incorporated as an integral part of the composite. While the invention finds particular utility in the manufacture of carpet, the composite which is produced can be used, per se, in draperies, upholstery, bedding materials, textile wall coverings, automobile fabrics, bedspreads or other types of textile products where heat dissipation is a problem.

While the physical characteristics of each of the layers making up the composite of the present invention will be dictated by the end use for the product, typical composite structures produced according to the present invention involve the use of a base fabric which is either woven or non-woven, and composed of natural or synthetic materials. The base material may be in the form of a scrim or in the form of an aligned network of filaments. Typically, the thickness of the fabric may range from about 0.005 to 0.050 inch.

A metallic foil such as an aluminum foil is mechanically bonded to the base fabric. The metallic foil is usually in the range of thickness from about 0.0001 to 0.005 inch.

The mechanical bonding between the components of the composite is achieved by needle punching the overlying fiber batt which itself can be composed of natural or synthetic fibers, such as cotton, wool, rayon, nylon, polypropylene, polyester, acrylic fibers, modified acrylics, or mixtures of various fibers. Typically, the length of the fibers in the fiber batt range from about ½ inch to 6 inches.

The base fabric, the metal foil and the fiber batt are bonded together mechanically by means of needle punching wherein a plurality of barbed needles is punched through the composite of fiber batts, foil and fabric as the composite is incrementally moved between strokes of the needles. Initially, the needle points penetrate the foil and fabric and the specially designed barbs draw the fibers from the fiber batt through the foil and fabric and against the back surface of the fabric base where they are entagled with the filaments of the fabric base. As the needles are withdrawn, the configuration of the barbs tends to pull the fibers back as the needles rise but the pulled back fibers are wiped from the sloping sides of the barbs as they pass through the base fabric. A number of fiber strands are, however, pulled back to the top of the foil and fabric layer leaving a securely mechanically bonded composite which, in the process of needle punching also becomes substantially densified. The needles are so closely spaced and the incremental movement of the composite is relatively small during the time the web advances, so that fibers which are displaced from the fiber batt by successive punches of the needles become intermeshed with each other and provide a strong mechanical locking action.

The resulting fabric can be used, per se, although it can be given the usual coat of latex and combined with tufted fibers to form a floor covering.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which.

DESCRIPTION OF THE PREFERRED EMBODIMENTS

Figure 1:
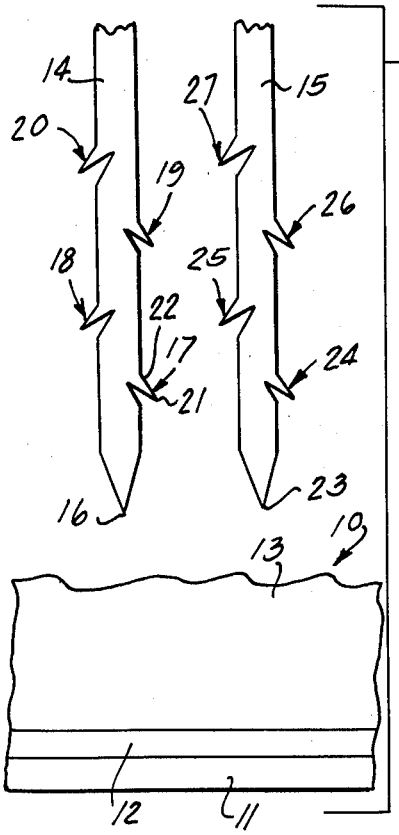
FIG. 1 is a somewhat schematic view on an enlarged scale illustrating the composite of the present invention just prior to the needle punching operation.

In FIG. 1, reference numeral 10 indicates generally a composite of the type used in the present invention and containing a primary fabric base layer 11. This fabric base 11 may be composed of any of a wide variety of materials, either woven or non-woven, of natural or synthetic origin. Thus, the fabric base may consist of diverse materials such as jute, cotton, wool, rayon, nylon, polypropylene, polyester, acrylics, or modified acrylics or mixtures thereof. The thickness of the fabric is ordinarily in the range from about 0.005 to 0.050 inch.

A metallic foil 12 typically having a thickness of about 0.0001 to 0.0050 inch is applied over the fabric base 11. Aluminum is the preferred material for the foil layer 12 although any metal having good heat conduction properties can also be used, such as magnesium, copper, and the like.

The metallic foil layer 12 is initially covered with a relatively loose fiber batt 13 which also can be composed of natural or synthetic fibers, including such materials as jute, cotton, wool, rayon, nylon, polypropylene, polyester, acrylics, modified acrylics, or mixtures thereof. The lengths of the fibers in the batt 13 will usually range from about ½ inch to 6 inches. Non-woven batts are produced in a variety of processes, including garnetting, air laying, or carding, all of which are suitable for producing the non-woven batts used in the present invention. Batts produced by garnetting usually evidence a substantial degree of fiber parallelism and for that reason it is advisable to cross-lay several garnetted batts to form the batt of the new composite to equalize, as far as possible, the strength characteristics of the batt in all directions.

The thickness of the batt 13 initially is many times the thickness desired in the final product as the needle-punching operation substantially reduces the thickness of the composite as an incident to interlocking of the fibers. With low density batts, the reduction in thickness of the batt during needle punching may be on the order of 10 to 1 or even more.

FIG. 1 illustrates two felting needles 14 and 15 just prior to the needle punching operation. The needles 14 and 15 are mounted in a suitable needle board (not shown) in very closely spaced relation. For example, there may be 40 to 50 needles per inch mounted on the needle board. The needle 14 has a pointed end 16 and a plurality of barbs 17 through 20 disposed in staggered relation around the shank of the needle 14. Each of the barbs 17 through 20 may be identical in configuration and including a barb point 21 which extends beyond the nominal diameter of the shank portion of the needle and a downwardly angularly extending surface 22 whose function will be apparent from a succeeding portion of this description. Similarly, the needle 15 has a pointed end 23 and barbs 24 through 27 in staggered relation therealong.

Figure 2:
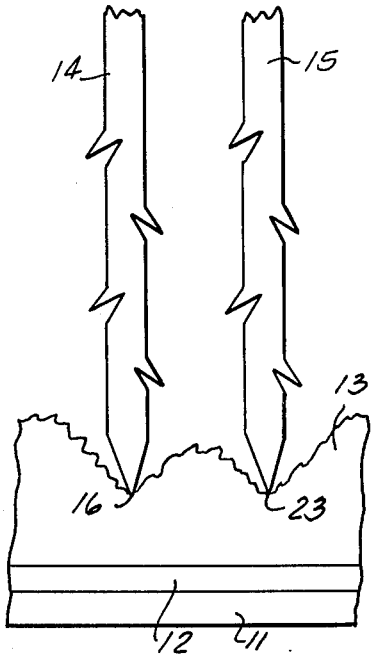
FIG. 2 is a view similar to FIG. 1 but showing the condition as the needles engage the fiber batt during the beginning of the downward stroke.

Referring now to FIG. 2, the needles 14 and 15 are shown with their pointed ends 16 and 23 penetrating into the batt 13. This creates an initial entry depression which eases the passage of the barbs and the fiber that follows.

Figure 3:
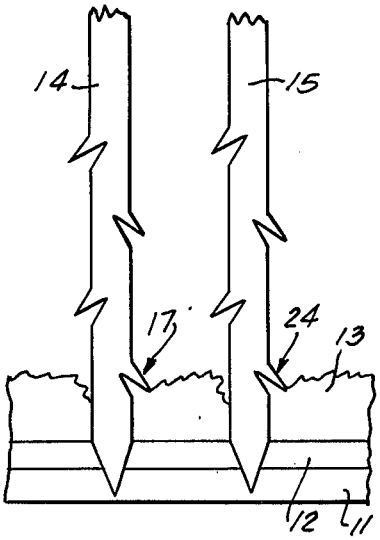
FIG. 3 is a view illustrating the composite just as the needles are about to break through the layer of base fabric.

In FIG. 3, the needle points 16 and 23 are shown after they have penetrated the foil 12 and the fabric base 11. At this point, the lowermost barbs 17 and 24 are beginning to draw fibers from the batt 13 downwardly.

Figure 4:
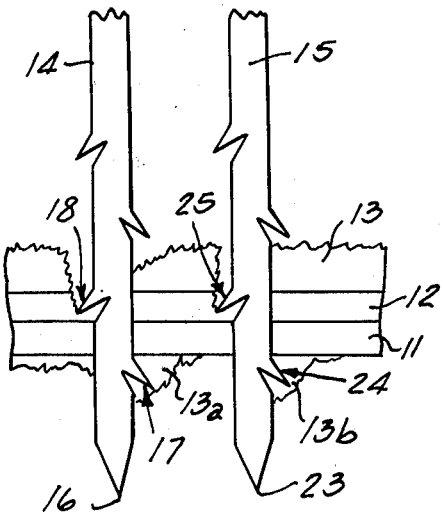
FIG. 4 shows the needles after they have penetrated through the composite and have drawn fibers from the fiber batt through the back of the base fabric.

In FIG. 4, the needle 14 and 15 are shown with their pointed ends 16 and 23 completely through the composite. The barbs 17 and 24 have each drawn a number of fibers from the batt 13 leaving fiber masses **13*a* and 13*b* at the base of the fabric 11, as shown in that Figure. At the same time, the barbs 18 and 25 are beginning to draw additional fibers from the batt 13** downwardly.

Figure 5:
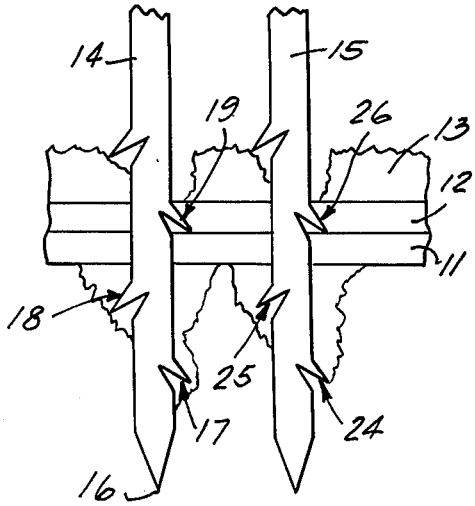
FIG. 5 shows the needles at substantially the limit of their downward travel.

In FIG. 5, the needles are shown substantially at their point of maximum penetration with the barbs 19 and 26 entering the fabric layer 11. The barbs 18 and 25 have pulled additional amounts of fibers from the batt 13. At the same time, the tension created by pulling the fibers from the batt 13 has substantially reduced the thickness of the batt 13 as evident from a comparison of FIG. 5 with FIG. 1.

Figure 6:
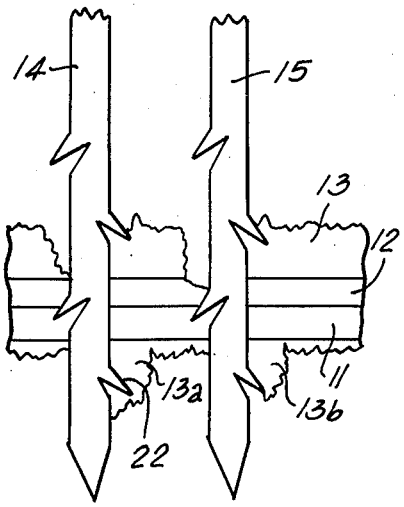
FIG. 6 illustrates the needles shortly after commencement of the upward stroke.

FIG. 6 illustrates the condition shortly after the needles 14 and 15 have begun their upward stroke. The needles then begin to pull a portion of the fiber deposits **13*a* and 13*b* back into place. The angular surface of the barb (such as surface 22) pulls the fiber back as the needle rises, the amount of return being governed by the angle of the surface 22**.

Figure 7:
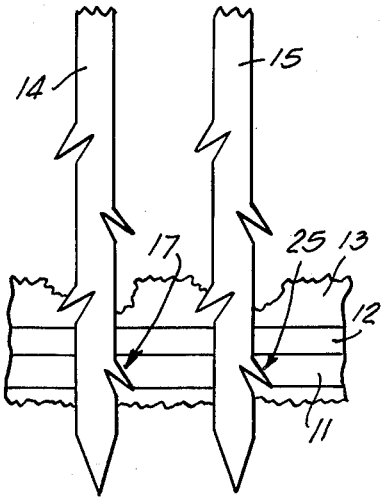
FIG. 7 shows the needles still further along in the retraction stroke.

In FIG. 7, the needles 14 and 15 are shown more completely retracted. The barbs 17 and 24 have reached the fabric layer 11 whereupon the pulled back fiber is essentially wiped from the angularly inclined surfaces of the barbs as they pass through the base fabric layer 11. A number of fiber strands are, however, pulled back to the top of the foil-fabric layer, creating a mechanically interlocked laminate of fiber batt 13, foil 12 and fabric 11.

Figure 8:
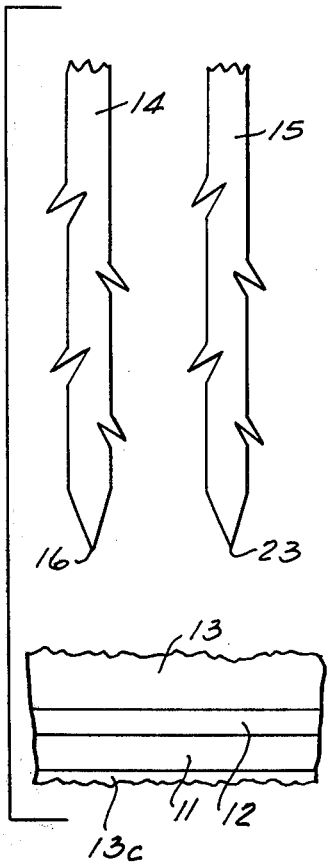
FIG. 8 shows the needles fully retracted after the needle punching operation.

In FIG. 8, the needles 14 and 15 are shown fully extracted. In this condition, the face of the composite along with the bottom surface thereof has been leveled out by the return fiber being caught by the barbs on their upward stroke. A continuous layer **13*c*** of fibers remains at the base of the composite.

After the extraction of the needles, the composite is incrementally moved a short distance and the needles are punched through the composite once more. In typical needle punching assemblies, it is common to have 800 to 1,200 needle punches per square inch of the composite.

Figure 9:
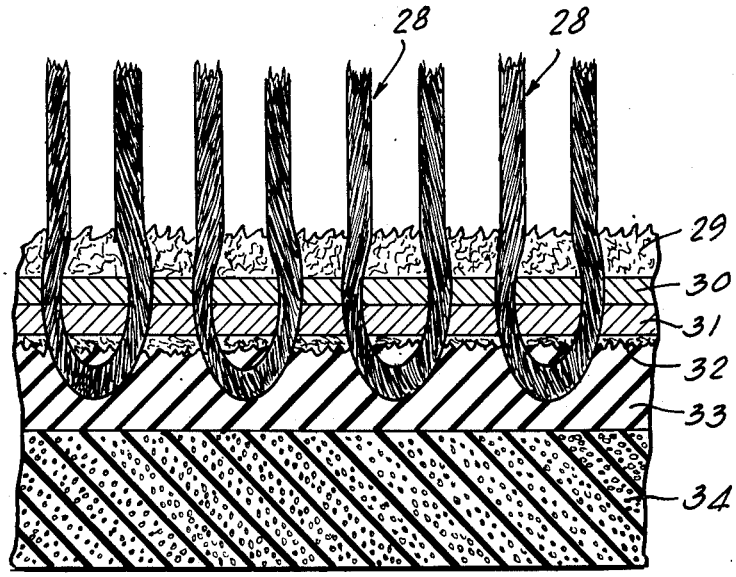
FIG. 9 is a cross-sectional view in highly magnified form of a tufted carpet construction utilizing the improved composite of the present invention.

While the composites produced according to the present invention have many uses, they are particularly useful in connection with the production of tufted carpeting as shown in FIG. 9. That Figure illustrates a carpeting containing fibrous pile tufts 28 extending through and anchored into a composite produced according to the present invention, including a densified non-woven batt 29 which is secured to an intermediate metallic foil layer 30 and a base fabric 31 by the needle punching process, and having a fiber layer 32 of displaced fibers forming the back surface of the fabric 31. A latex backing 33 may be provided to the carpet structure in the usual manner and this may be supplemented by a secondary backing 34 consisting of foam rubber, foamed flexible polyurethane, foamed polyvinyl chloride or other resilient sponge-type materials used in carpeting applications.

When used as a primary back for a tufted carpet, the composite of the present invention is sufficiently strong to go through the necessary manufacturing procedures. The fiber face formed on the back of the tufting back by the needle punching operation will accept dye stuffs used on the pile fibers.

The metallic foil shield at the base of the pile fibers is capable of dissipating heat from the point of application, thereby helping the pile fibers from reaching their flash point of ignition. The metallic foil incorporated in this product does not add to the smoke or toxic gas emission which may occur with the use of chemical compounds or adhesives when subjected to heat and/or flame. The metallic foil shield also assists in preventing soil penetration into the carpet back.

The presence of the metallic foil as an integral part of the structure also tends to dissipate the amount of static electricity which is generated when certain types of synthetic fibers are used as the face pile. Static generating carpets are not used in areas such as computer rooms, hospital areas and the like, and the new backing material substantially reduces static accumulation and at the same time provides fire retardency, thereby making carpets produced with the improved composite of the present invention usable in areas where they were previously not acceptable.

It should be evident that various modifications can be made to the described embodiments without departing from the scope of the present invention.

I claim as my invention:

1. A fabric composition comprising
a fabric base,
a heat conductive initially continuous sheet-form metal foil overlying said base,
a non-woven batt of fibers overlying said metallic foil,
and a plurality of mechanical interlocks joining the base, the foil and the batt and more specifically comprising
a plurality of tufts of fibers from said batt extending in one direction through said foil through spaced apart needle punched apertures in the foil without impairing the unbroken thermal conductivity continuity of the foil between the apertures,
some of said fibers extending back in an opposite direction through the same apertures in the foil,
said batt and said foil being mechanically locked to said base solely by said fibers of said batt which have been pushed through said foil and said base to form fiber masses which are locked against the bottom of said base,
said foil forming unbroken continuous conductive paths to conduct heat away from a point of application to said composition for dissipation throughout the fabric composition.

2. The fabric composition of claim 1 in which the fibers in said batt have an average length in the range from ½ inch to 6 inches.

3. The fabric composition of claim 1 in which the thickness of said metallic foil is in the range from 0.0001 to 0.005 inch.

4. The fabric composition of claim 1 in which said base has a thickness of from 0.005 to 0.050 inch.

5. The method of making a heat dissipating fabric which comprises
applying a continuous metallic foil over a web of a fabric base,
applying a non-woven batt of fibers over said foil and
needle punching the resulting composite with barbed needles from one direction only by successively penetrating first the batt, then the foil and finally the base to form fiber masses on the free side of the fabric base and to force fibers from said batt back and forth through spaced apart needle punched apertures in said foil and through said fabric base,
said needle punching operating to densify said composite and forming plural mechanical interlocks to securely interlock said fabric base, said foil and said batt together, while maintaining said foil in a sheet-form condition,
whereby said foil forms continuous conductive paths in the fabric to conduct heat away from a point of application to said composition for dissipation throughout the composition.

6. The method of claim 5 in which the fibers in said batt have an average length in the range from ½ inch to 6 inches.

7. The method of claim 5 in which the thickness of said metallic foil is in the range from 0.0001 to 0.005 inch.

8. The method of claim 5 in which said base has a thickness of from 0.005 to 0.050 inch.

9. The method of claim 5 in which said metal foil is composed of aluminum.

10. The method of claim 5 in which the fibers in said batt have an average length in the range from ½ inch to 6 inches, the thickness of said metallic foil is in the range from 0.0001 to 0.005 inch, and said base has a thickness of from 0.005 to 0.050 inch.

11. A flame retardant fabric composition comprising a composite article having,
a primary base layer composed of fabric and being in the order of about 0.005 to 0.050 inches, in thickness,
a sheet-form metallic foil forming a thermally conductive continuous thermal foil layer having one side completely overlying an adjoining side of said base layer and being in the order of about 0.0001 to 0.005 inches in thickness,
a fiber batt corresponding in size to the article and having one side overlying the other side of said thermal foil layer,
said batt having fibers of a length in the order of from about one-half inch to six inches,
a plurality of mechanical interlocks constituting the sole means of interconnecting the base layer, the foil and the batt and more specifically comprising
selected fibers from said batt extending in one direction through spaced apart needle punched apertures in said foil layer and through said base layer and forming fiber masses at the opposite side of said base layer,
a number of fiber strands from said fiber masses extending back through said needle punched apertures in said foil in an opposite direction to the exposed side of said batt,
said selected fibers at said fiber strands forming interlocks for the layers and being disposed in a uniform array of the article at spaced discreet locations to leave unbroken thermal conductivity paths in the foil which extend throughout the entire article between the interlocks,
whereby the base layer and the foil layer and the batt are mechanically interlocked by said selected fibers and said fiber strands to form a densified laminate having a thermally conductive intermediate layer forming unbroken conductive paths to conduct heat away from any point of application to said article for dissipation throughout the composite article.

12. A composite article as defined in claim 11 and a supplemental backing material bonded thereto
which supplemental backing material is selected from the class consisting of latex, foam rubber, foamed flexible polyurethane, foamed polyvinyl chloride, and resilient type material.

13. A composite article as defined in claim 11 and carpet tufting integrated with said article so that
said article forms the primary back for the carpet.

14. The method of making a composite fire retardant fabric article which includes the steps of
interposing a foil part made of a thin initially continuous sheet-form conductive material between a base part made of fabric and a batt part made of loose fibers to form a sandwich laminate initially of many times the thickness of the finished fabric article, mechanically interlocking the laminate by needling the sandwich with successive punching strokes from only one direction, during each said punching stroke successively penetrating first the batt to displace and draw fibers from the batt, then penetrating the foil, and then penetrating the fabric base, throughout said needle punching stroke and during each such successive penetrations continuing to draw the fibers displaced from the batt through a plurality of spaced apart needle punched apertures in the foil to thereby form and leave fiber masses at the fabric base, pulling back a portion of the thus formed fiber masses by retracting a number of fiber strands during a return needle stroke in an opposite direction through said same apertures in the foil to thereby pull some of the displaced fiber strands back through the fabric base, the foil and the loose fiber batt, and spacing the punching strokes sufficiently to leave unbroken thermal conductivity paths extending throughout the composite article, whereby there is formed a mechanically interlocked densified unitary fabric article of conductive foil, fabric base and fiber batt.

* * * * *

Notice of Adverse Decision in Interference

In Interference No. 100,316, involving Patent No. 4,062,993, W. W. Seward, TEXTILE AND METHOD OF MAKING SAME, final judgment adverse to the patentee was rendered Feb. 25, 1981, as to claims 1 and 5.

[*Official Gazette August 25, 1981.*]